US009016607B2

(12) United States Patent
Wong et al.

(10) Patent No.: US 9,016,607 B2
(45) Date of Patent: Apr. 28, 2015

(54) MULTI-STAGE RETRACTABLE CORD WINDER DEVICE

(71) Applicants: Weituck Wong, Dongguan (CN); Guoqing Zhou, Dongguan (CN)

(72) Inventors: Weituck Wong, Dongguan (CN); Guoqing Zhou, Dongguan (CN)

(73) Assignee: Dongguan Pengteng Hardware Electronic Co., Ltd., Dongguan (CN)

( * ) Notice: Subject to any disclaimer, the term of this patent is extended or adjusted under 35 U.S.C. 154(b) by 0 days.

(21) Appl. No.: 13/735,047

(22) Filed: Jan. 7, 2013

(65) Prior Publication Data

US 2014/0191072 A1 Jul. 10, 2014

(51) Int. Cl.

| | |
|---|---|
| ***B65H 75/48*** | (2006.01) |
| ***H01R 13/60*** | (2006.01) |
| ***H01R 13/72*** | (2006.01) |
| ***B65H 75/44*** | (2006.01) |
| *H04R 1/10* | (2006.01) |

(52) U.S. Cl.

CPC ..... *H01R 13/60* (2013.01); *H01R 13/72* (2013.01); *B65H 75/4434* (2013.01); *B65H 2701/3919* (2013.01); *H04R 1/1033* (2013.01)

(58) Field of Classification Search

CPC ..... B65H 75/486; B65H 75/4402; B65H 75/4434; B65H 75/4442

USPC ..... 242/378, 378.1–378.4

See application file for complete search history.

(56) References Cited

U.S. PATENT DOCUMENTS

| | | | | |
|---|---|---|---|---|
| 7,222,812 | B2 * | 5/2007 | Chang et al. | 242/378.1 |
| 7,364,109 | B2 * | 4/2008 | Kuo | 242/373 |
| 7,384,013 | B2 * | 6/2008 | Yen | 242/378 |
| 8,136,751 | B2 * | 3/2012 | Chen | 242/378.1 |
| 2006/0027433 | A1 * | 2/2006 | Wu | 191/12.2 R |

* cited by examiner

*Primary Examiner* — Sang Kim

(74) *Attorney, Agent, or Firm* — Novoclaims Patent Services LLC; Mei Lin Wong

(57) ABSTRACT

A retractable cord winder device, which has a front cover with center shaft, a spiral spring, a spool with a spool divider with flanged hook dividing the spool chamber into equal halves for efficient and minimal noise cable coiling, oval sliding positioning sliding disc, and a rear cover with concave recess to hold the oval positioning sliding disc with positioning stopper. The front cover is mounted with the rear cover through the center shaft via a center hole of the rear cover where there are symmetrical openings on both ends for cords folded in half to be attached to the flanged hook and retracted upon pulling down.

3 Claims, 6 Drawing Sheets

MULTI-STAGE RETRACTABLE CORD WINDER DEVICE

FIELD OF THE INVENTION

The present invention relates to a retractable cord winder device which automatically winds up cords, and in particular, to MP3 and Smartphone's charging cables and all existing Earphones such that an appropriate cord is retracted and positioned to facilitate application.

BACKGROUND OF THE INVENTION

The length of a cord for MP3 and Smartphone's charging cables and Earphones cannot be adjusted to comply with the need of the user. Accordingly, it is very often that the length is either too long or too short and therefore, it is rather troublesome for usage and storage with entanglement. Conventional way of providing an appropriate length of the cord for usage is by coiling the cord manually and tying with cable ties or Velcro straps. Although there are springs loaded automatic cord wind but it cannot be retracted and positioned at desired length to facilitate application. It is an object of the present invention to provide a multi-stages retractable cord winder device which mitigates the above drawbacks. The retractable cord winder provides a high quality and efficient application for all MP3 and Smartphone's cords and Earphones.

SUMMARY OF THE INVENTION

Accordingly, it is an object of the present invention to provide a multi-stages retractable cord winder which allows an appropriate length of the cord to be retracted automatically. It is particularly useful for retrofitting the existing conventional cords, cables or wires for electronic devices, for example, MP3, Smartphones, earphones and other portable devices and their accessories.

Still another object of the present invention is to provide a multi-stage retractable coiling cord device, wherein the appropriate length of the cord can be accurately positioned.

A further object of the present invention is to provide a multi-stage retractable cord winder device, wherein the retractable cord can be easily and rapidly restored to its original position for easy operation.

The following detailed description of the invention and the claims should be read in conjunction with the accompanying drawings. Throughout the specification and drawings identical reference numerals refer to identical or similar parts.

The detailed description and the accompanying sheets of drawings in which a preferred structural embodiment incorporating the principles of the present invention is shown by way of illustrative example.

DETAILED DESCRIPTION OF PARTICULAR EMBODIMENTS OF THE INVENTION

Figure 1:
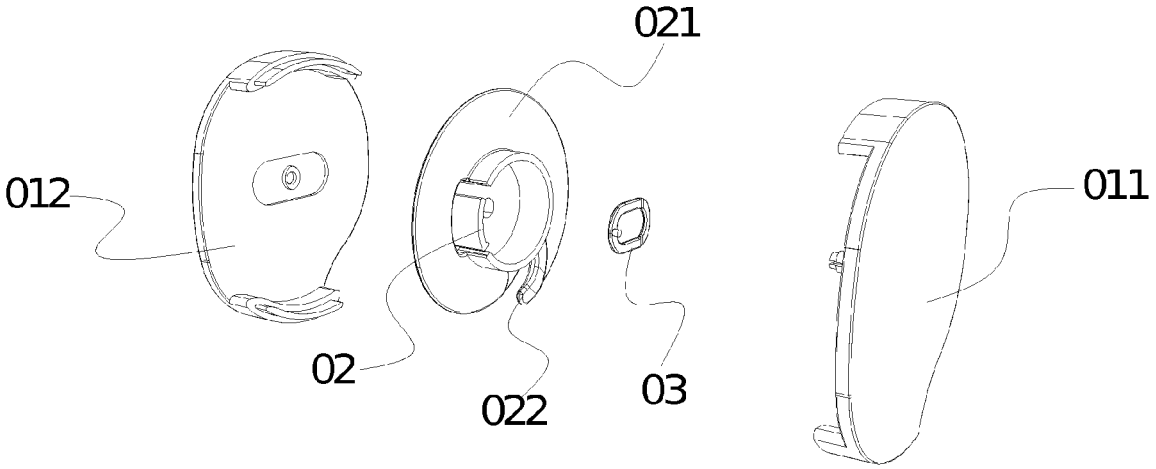
FIG. 1 is an exploded left-to-right perspective view of a multi-stage retractable cord winder of a preferred embodiment in accordance with the present invention.

The following terms are referenced to by the corresponding numerics in FIGS. 1-6:

01—Multi-stages retractable cord winder; 012—Rear cover with recess groove to hold oval sliding positioning disc with hole for center shaft attachment from front cover; 011—Front cover with center shaft to hold cord winder together; 02—Spool; 021—Spool divider; 022—Flange hook; 03—Oval sliding positioning disc; 031—Stopper; 04—Recess groove on rear cover to hold oval sliding positioning disc; 041—Small hole in recess opening in rear cover to for center shaft insertion from front cover; 05—Center shaft.

The invention will now be further illustrated with the aid of schematic drawings. It is understood that drawings are schematic in nature solely for illustrating the main concept of the present invention and as such they may not be accurate, for example, in terms of the number and size of the yarns depicted in the drawings.

Figure 2:
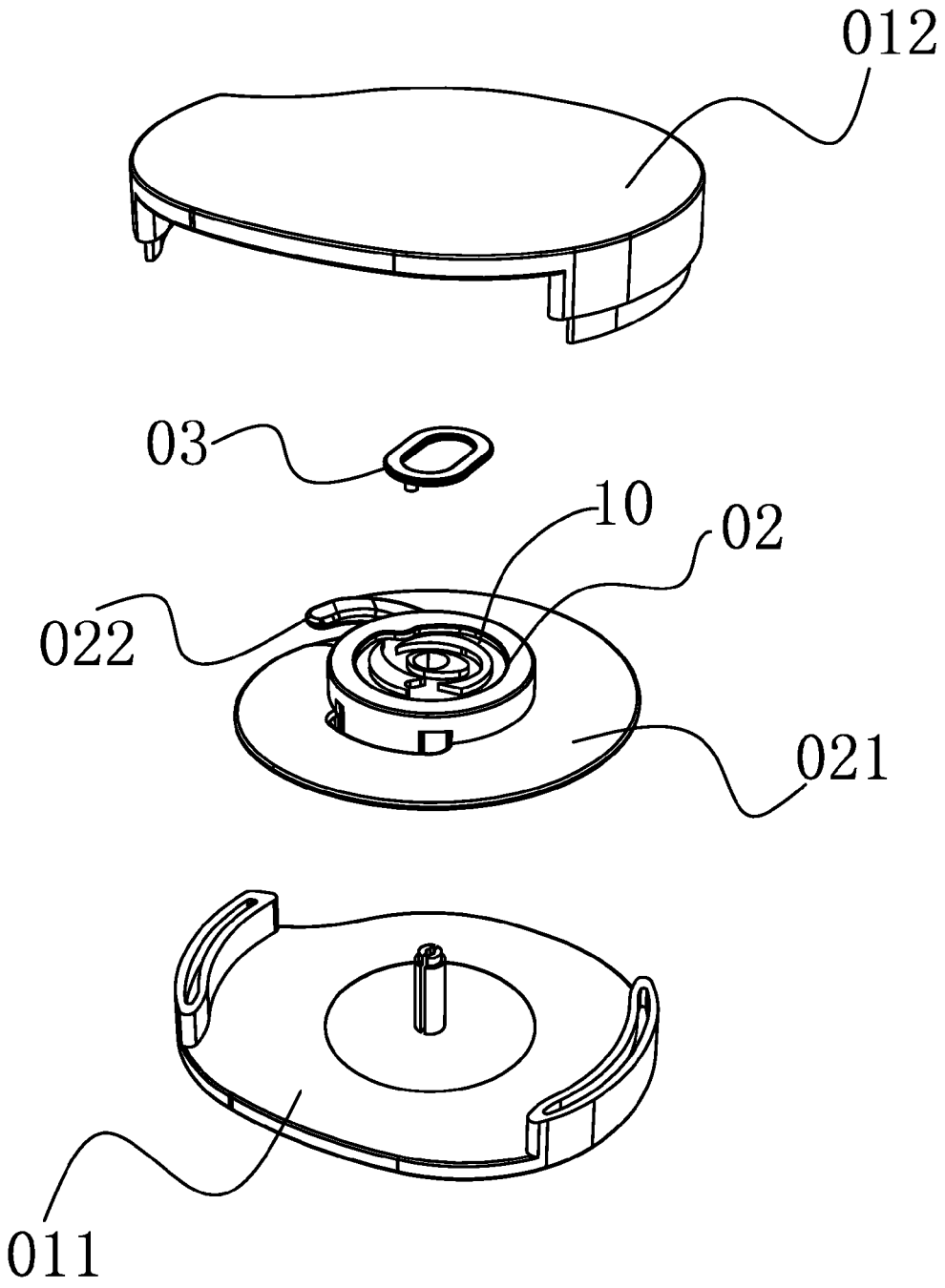
FIG. 2 is another exploded top-to-bottom perspective view of the multi-stage retractable cord winder of the present invention.
Figure 3:
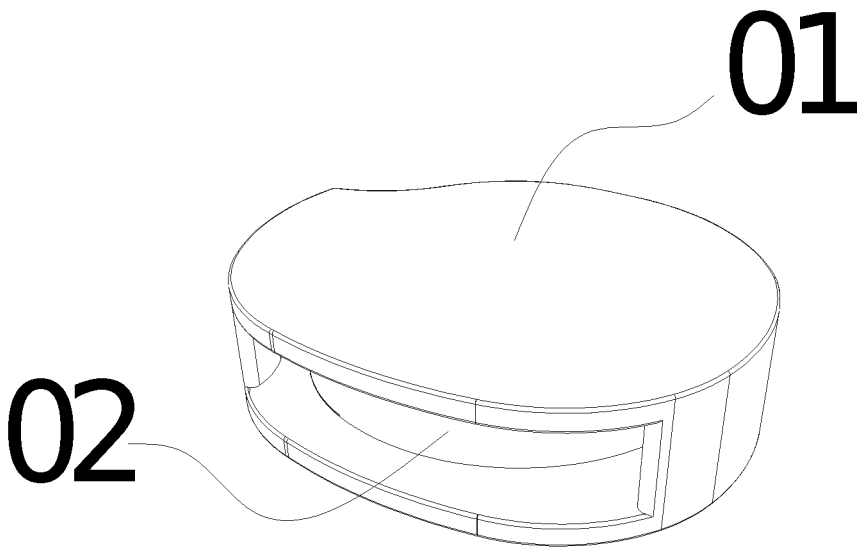
FIG. 3 is a perspective view of the multi-stage retractable cord winder of the present invention.
Figure 4:
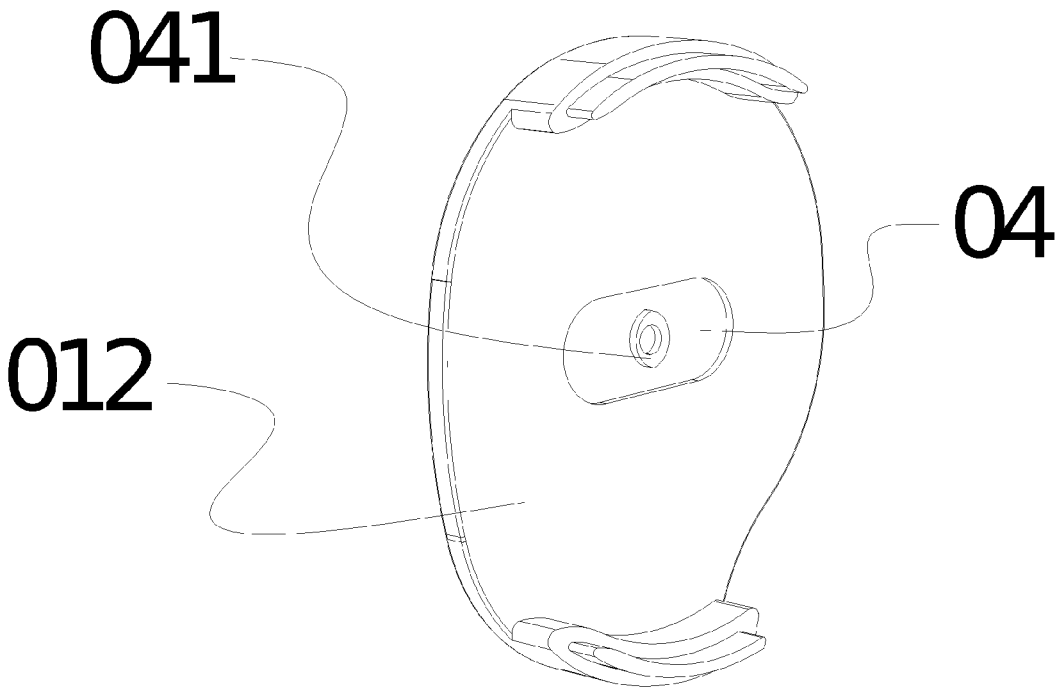
FIG. 4 is a sectional view of the rear cover showing the recess groove that will hold the oval sliding positioning disc with stopper and the central hole for attachment for the center shaft from the front cover.
Figure 5:
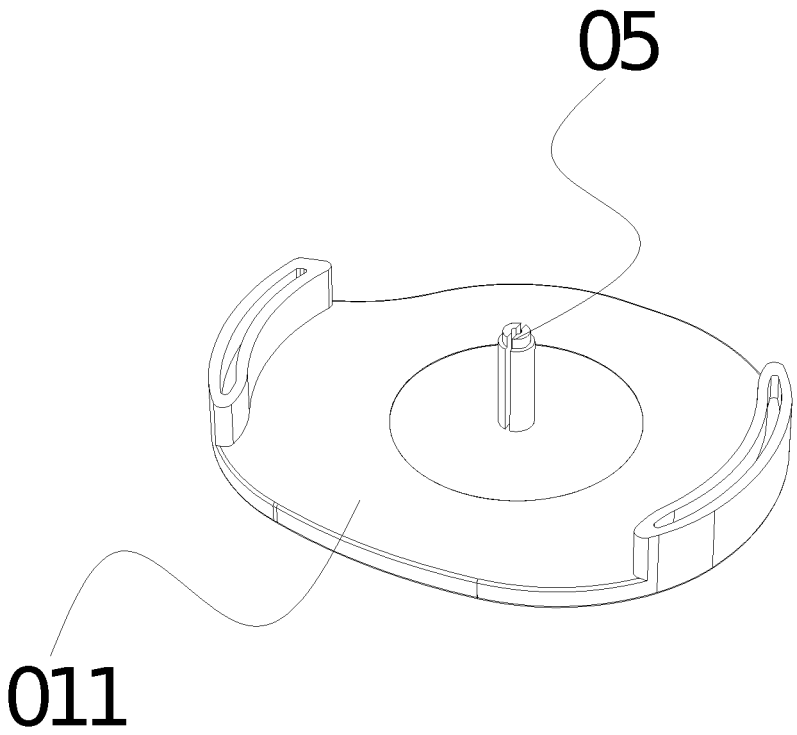
FIG. 5 is a schematic view showing the front cover with the center shaft that will hold the multi-stages retractable cord winder together.
Figure 6:
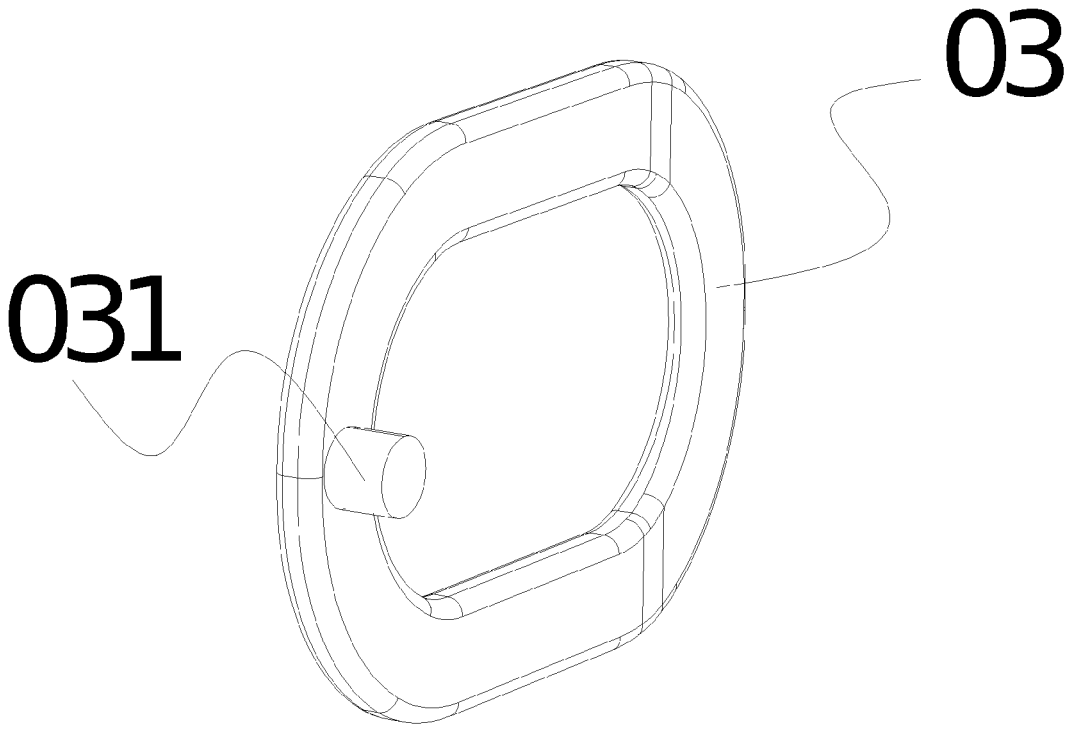
FIG. 6 is a schematic view showing oval shape sliding positioning disc with stopper that functions as the key for smooth retraction properties and minimize noise for the multi-stage retractable cord winder.

Referring to FIGS. 1 and 2, the multi-stage retractable cord winder device comprises a front cover 011, a spool 02, an oval sliding positioning disc 03, a spool divider 021, a spool flange hook 022 and a rear cover 012. A spiral spring 10 is inserted in 02 in the spool as shown in FIG. 1 while the oval sliding positioning disc with stopper 031 shown in FIG. 6 rests on the positioning tracks of the spool 02 shown in FIG. 2 the oval sliding positioning disc 03 sits in the recess opening 04 in the rear cover 012 as shown in FIG. 4. The center connecting shaft 05 shown in FIG. 5 will be inserted into central hole 041 in recess opening of rear cover 012 to hold the multi-stage retractable cord winder together. The assembled winder device is shown in FIG. 3.

To retract a cord, fold the cord in the center point along its length (i.e., the center point divides the cord into two segments of equal length) and form a bend to loop onto flange hook of spool by pulling down gently and entire cord will be retracted exposing the 2 ends.

When the 2 ends of the retraction cord pulls the oval positioning sliding disc to move one round, a positioning mechanism is generated. If the retraction cord is pulled to exceed the second positioning structure, the next positioning is achieved subsequently. Accordingly, the present invention allows multiple stages of positioning when the retraction cord is pulled or retracted.

In summary, the present invention provide a retractable cord winder device comprising a front cover with center shaft, a spiral spring, a spool with a spool divider with flanged hook dividing the spool chamber into equal halves for efficient and minimal noise cable coiling, oval sliding positioning sliding disc, and a rear cover with concave recess to hold the oval positioning sliding disc with positioning stopper, characterized in that the front cover is mounted with the rear cover through the center shaft via a center hole of the rear cover where there are symmetrical openings on both ends for cords folded in half to be attached to the flanged hook and retracted upon pulling down.

The oval sliding positioning disc with stopper runs on track of the spool for multistage retraction for usage, and the disc sits in a recessed opening in the rear cover providing minimal restricted left to right movements resulting in very smooth retraction properties and minimal noise compared to positioning bead with sliding disc or other sliding disc retraction methods in the art.

The front cover is attached through the center shaft through the spool with flange hook and oval positioning disc to a center hole in the middle of the rear cover in the recess opening holding the sliding disc.

In use, most MP3 and Smartphone's charging cables and Earphone cables can be retracted automatically by locating the middle of the cable by forming a bend on hook onto the flange hook on spool by pulling down gently. For multi-stage retractable usage, just pull both ends of cables or earphone cables to a desired length for proper applications. The new oval sliding positioning disc of the present invention is suitable for use in other applications with embedded cords for single or double pull retractable cables assembly.

While there have been described and pointed out fundamental novel features of the invention as applied to a preferred embodiment thereof, it will be understood that various omissions and substitutions and changes, in the form and details of the embodiments illustrated, may be made by those skilled in the art without departing from the spirit of the invention. The invention is not limited by the embodiments described above which are presented as examples only but can be modified in various ways within the scope of protection defined by the appended patent claims.

What is claimed is:

1. A retractable cord winder device for extending and retracting a cord, comprising:

a main casing, which comprises:

a front cover having a center connecting shaft; and a rear cover attached on said front cover through said center connecting shaft to form a spool chamber between said front cover and said rear cover, each of said front cover and said rear cover having a recess to form an opening of said main casing;

a spool accommodated in said receiving cavity;

a spool divider frontwardly extended from said spool;

a flanged hook extended from said spool divider;

an oval sliding positioning disc received in said spool divider, said oval sliding positioning disc having a positioning stopper; and a spiral spring supported in said spool divider, wherein said cord is attached to said flanged hook and is folded in half, so that when said cord is pulled or retracted for a predetermined length, said oval sliding positioning disc is also driven to rotate at a maximum of 180° while said positioning stopper is arranged to stop said cord from being further pulled or retracted.

2. The retractable cord winder device, as recited in claim 1, wherein said rear cover has an indention for forming a recess opening, said oval sliding positioning disc being accommodated in said recess opening.

3. The retractable cord winder device, as recited in claim 2, wherein said rear cover further has a central hole formed at said indention, wherein said center connecting shaft is connected to said central hole.

* * * * *